United States Patent [19]

O'Toole

[11] 4,064,662

[45] Dec. 27, 1977

[54] COLLAPSIBLE TETRAHEDRAL STRUCTURE

[76] Inventor: John M. O'Toole, 3771 Las Flores Court, Los Angeles, Calif. 90034

[21] Appl. No.: 727,960

[22] Filed: Sept. 29, 1976

[51] Int. Cl.[2] ..... E04B 1/343

[52] U.S. Cl. ..... 52/71; 46/1 L; 46/21; 52/81; 52/10 S; 135/4 C; 229/22

[58] Field of Search ..... 52/222, 81, 63, 64, 52/71, 70, 105; 229/22; 135/4 R, 4 C; 35/72; 46/1 L, 21

[56] References Cited

U.S. PATENT DOCUMENTS

| | | | |
|---|---|---|---|
| 2,835,931 | 5/1958 | Sterkin | 52/70 |
| 2,936,939 | 5/1960 | Lundquist | 52/DIG. 10 |
| 3,042,052 | 7/1962 | Des Rosier | 135/4 C |
| 3,267,597 | 8/1966 | Jannes | 52/DIG. 10 |
| 3,319,684 | 5/1967 | Calhoun | 229/41 R |
| 3,359,657 | 12/1967 | Hedberg | 35/72 |
| 3,461,574 | 8/1969 | Larsen et al. | 52/DIG. 10 |
| 3,730,818 | 5/1973 | Salinari | 52/DIG. 10 |
| 3,759,277 | 9/1973 | Glade | 52/71 |
| 3,899,123 | 8/1975 | Stollberg et al. | 229/41 R |
| 3,937,426 | 2/1976 | Pearce | 52/DIG. 10 |

FOREIGN PATENT DOCUMENTS

| | | | |
|---|---|---|---|
| 758,968 | 1/1934 | France | 229/22 |
| 299,795 | 8/1932 | Italy | 229/22 |

*Primary Examiner*—Leslie Braun
*Attorney, Agent, or Firm*—Henry M. Bissell

[57] ABSTRACT

A collapsible rigid lodgment structure erectable from a single blank and collapsible to a relatively small, compact and transportable size is shown and described. The structure when collapsed can be folded by folds and bifurcations to have an area approximately one-fourth the area of the blank from which the structure is made. When erected, the structure is generally in the form of a tetrahedron. The structure when erected is suitable for expedient use as a hut or shelter.

18 Claims, 15 Drawing Figures

COLLAPSIBLE TETRAHEDRAL STRUCTURE

BACKGROUND OF THE INVENTION

1. Field of the Invention

This invention relates to shelter-type structures and, more particularly, to such structures that are portable, collapsible, and easily and quickly erectable for providing quick and accessible shelter against the elements in any locations.

2. Description of the Prior Art

It has long been known to construct containers and other structural elements from a single blank or as few relatively flat, foldablle blanks as possible. The containers may be used to transport material within them, or may be used as shelters. Moreoever, it has long been known to provide an erectable tent, hut or similar structural lodgment from small, concisely packaged materials such as rolled canvas, plastic sheets, cardboard, plywood and the like, which when packaged is concise and transportable but which when erected or extended into a usable form can provide the desired lodgment, shelter or the like. Such collapsible structures are known to be highly portable, often lightweight and frequently packaged in easily transported shapes. Many such structures when erected quite satisfactorily afford shelter from elements or carry goods for transportation as desired. Many such structures are designed to combine with identical or distinctly designed structures so as to form a larger structure, if more than one of such individual, collapsible, portable structures may be purchased or employed by the user. It is often desired, however, to provide such a highly satisfactory, highly portable and collapsible structure for use as a shelter, where the shelter is very inexpensively constructed with inexpensive materials requiring simple manufacturing operations in order to achieve the finished product.

SUMMARY OF THE INVENTION

The present invention contemplates the provision of a single, generally rectangular blank which has selected folds and bifurcations joined at its shorter edges so that when extended beyond the relatively flat, planar packaged mode, the blank can be formed into a tetrahedral structure whose interior can be used for containing goods and for sheltering users.

In one embodiment of the invention, the tetrahedral shape is erected by joining the shorter edges of a generally rectangular blank, having small flaps or edge sections scored to make weatherproof corners. When constructed in this embodiment, the structure has the shorter edges of the rectangular blank at least partially joined, the remaining portion of the shorter edges being unjoined to provide a door or entrance to the interior of the tetrahedron when erected. When erected, the rectangular blank forms a tetrahedron requiring a joinder along one of the six tetrahedron edges or corners. Preferably, the shorter edges and sections being either joined or closed together are slightly longer than the length of a normal corner of the tetrahedron, so to provide overlap of the closable edges, and to provide ventilation for the interior of the tetrahedral structure along those parts of the edges joined. A pair of cords or other closing means are provided, one each on the shorter edges. The closing means can be used to tie up the bundle when it is in its flat or portable state, and may be used with the tetrahedral structure in the erected state for tying the door edges together. When in the erected condition, flaps are folded over the corner and secured to the adjacent, abutting side of the tetrahedron by fastening means such as, for example, Velcro fasteners.

In one embodiment of the invention, the rectangular blank can be constructed of corrugated cardboard. The folds and bifurcations can be developed by scoring the corrugated cardboard along the lines where the folds and the bifurcations are to be located. The shorter edges of the rectangular blank form the edges of the door panels providing access to the tetrahedral shelter. The corrugated cardboard could be impregnated with wax or other treating substances to provide waterproofing, or weatherproofing as desired.

The structure can be made of other materials, such as for example fabrics, plastics and the like. If the structure is made with less than rigid materials it is contemplated that rods or poles inserted through tubes sewn along the bifurcations or fold lines will be used to provide a frame for strength. A common support may be used at the apex to secure the rods, poles or tubes together, thus establishing a rigid frame for supporting the less that rigid material, such as fabrics, plastics and the like. The rods or poles optionally may be removed from the tubes and the material may be rolled or folded for easy transportation.

The tetrahedral structure may also be made in a more rugged form by cutting the panels from more rigid material such as plywood, and joining the panels or sides together with hinges along bifurcation and fold lines.

BRIEF DESCRIPTION OF THE DRAWINGS

A better understanding of the present invention may be had from a consideration of the following detailed description taken in conjunction with the accompaning drawings, in which.

DESCRIPTION OF THE PREFERRED EMBODIMENT

Figure 1:
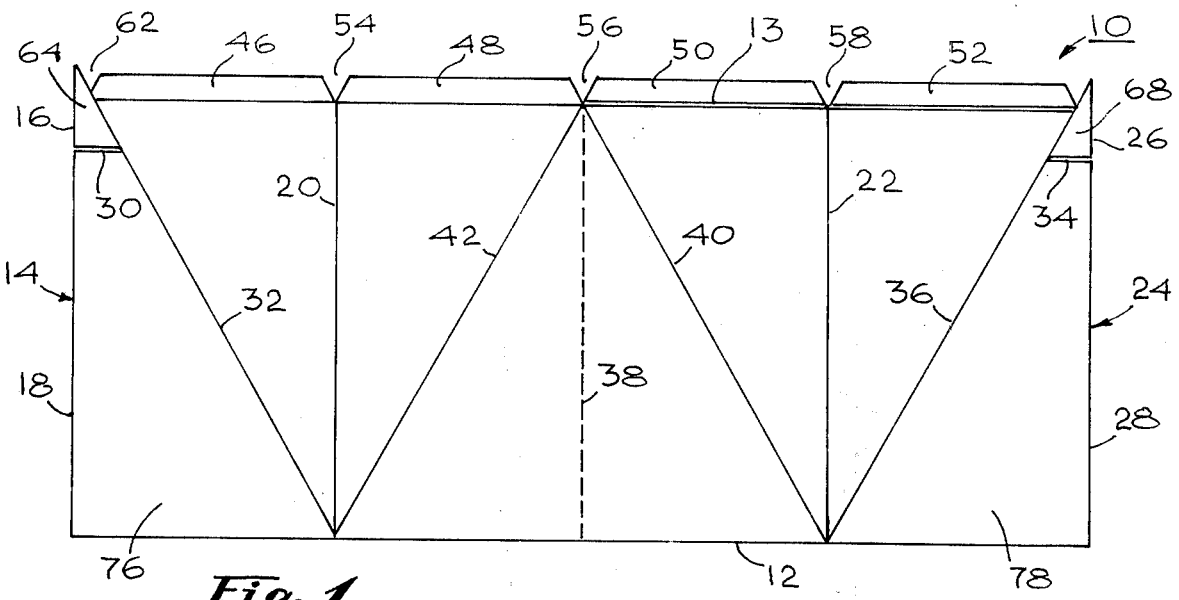
FIG. 1 illustrates a rectangular blank from which the embodiment of the invention may be constructed.

In FIG. 1 is seen a generally rectangular blank 10 which may be a blank cut from corrugated cardboard, rigid plastic or the like. In an alternative embodiment which will be described in more detail below, the blank may also be cut from more rugged material such as plywood, or more flexible materials such as fabric and flexible plastic and the like. The generally rectangular blank 10 will be referenced in this description according to its generally parallel longitudinal edges 12, 13 and according to its relatively shorter, generally parallel edges 14, 24. The relatively shorter edges 14, 24 may be referenced as the vertical edges also.

The blank 10 is scored first along lines 20, 22 so that the scoring goes completely from one longitudinal edge 12 to the other longitudinal edge 13, or the entire vertical distance of the generally rectangular blank 10. The fold 20 is generally parallel to the shorter edge 14, and is spaced approximately one-quarter the distance from the shorter edge 14 along the longitudinal length of the rectangular blank 10. Similarly, fold 22 extends completely along the vertical distance of the blank 10, from edge 12 to the opposite longitudinal edge 13. The fold 22 is parallel to the edge 24 and is spaced from the edge 24 approximately one-quarter the longitudinal distance of the blank 10.

The edge 14 is divided into two sections or portions 16 and 18. Dividing the sections 16 and 18 is a longitudinal cut 30 made at least as far as the fold 32 which will be described in more detail below. Similarly, edge 24 is divided into two portions 26 and 28 by cut 34 made longitudinally from the edge 24. The longitudinal cut 34 is made at least to fold 36, which will be described in more detail below.

A scoring 32 is made diagonally from the intersection of scoring 20 and longitudinal edge 12 to the end of the shorter edge 14. Similarly, scoring 36 is made from the intersection of the fold 22 and the longitudinal edge 12, to the end of edge 24. A bifurcation 38 should be made dividing the blank 10 approximately into two equal sections. The bifurcation 38 can be facilitated by a scoring made on the side of the blank 10 opposite that from view in FIG. 1. The bifurcation 38 should be parallel to the folds 22, 20 and to the edges 14, 24. The scorings 32 and 36 define bifurcations about which the blank 10 may be folded.

Bifurcation 40 should be formed by a scoring diagonally made from the intersection of the fold 22 and the longitudinal edge 12, to the intersection of bifurcation 38 and the longitudinal edge 13. Similarly, a diagonal bifurcation 42 should be made by scoring the cardboard blank 10 from the intersection of fold 20 and the longitudinal edge 12, to the intersection of bifurcation 38 and the longitudinal edge 13. Thus it may be seen that the diagonal bifurcations 32, 42, 40 and 36 are connected end to end on the blank 10. Moreover, the scoring for the bifurcations 32, 42, 40 and 36 as well as for the folds 20, 22 are all made on one side of the blank 10. Scoring on the opposite side of blank 10 is required only for the bifurcation 38. All bending of the blank 10 about the bifurcations and folds, therefore, will occur in one direction relative to the plane of the blank 10, except in the case of the bifurcation 38.

A triangular-shaped blank section 64 is defined by the bifurcation 32, the cut 30 and the edge portion 16. On this lefthand section of the blank 10, the remaining left extremity constitutes door 76 defined by the bifurcation 32, the cut 30, the edge portion 18 and a portion of the longitudinal edge 12. Similarly on the right extremity of the blank 10 as seen in FIG. 1, a triangular-shaped blank section 68 is defined by bifurcation 36, the cut 34 and edge portion 26. Door 78 in the extreme right portion of blank 10 is defined by bifurcation 36, cut 34, edge portion 28 and longitudinal edge 12. The purpose of the doors 76 and 78 will be explained in greater detail below.

Flaps 46, 48, 50 and 52 are created along the longitudinal edge 13 in the blank form 10. The flaps are made foldable by scoring along the longitudinal edge 13. Notches 54, 56 and 58 are formed in the blank material between the flaps to eliminate interference when folding and erecting. The edge of flap 46 adjacent to edge of flap 48 forms a 60° angle in the notch 54 therewith. Similarly, the adjacent edges of flaps 48 and 50 form a 60° angle in the notch 56. Also, the adjacent edges of flaps 50 and 52 form a 60° angle in the notch 58 when walls are to be equilateral triangles only. Other angles are formed for other triangles.

Notch 62 is formed between the flap 46 and the blank section 64. Notch 62 has a 60° angle between the section 64 and the flap 46. Similarly, notch 66 is formed from the blank 10 between the flap 52 and blank section 68. Notch 66 similarly results in a 60° angle between flap 52 and section 68.

Figure 2:
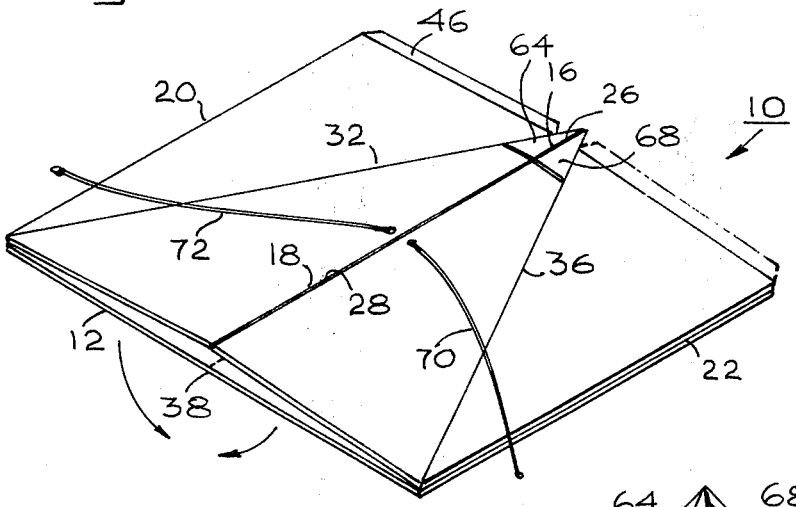
FIG. 2 shows a construction of the blank of FIG. 1 ready for use.
Figure 3:
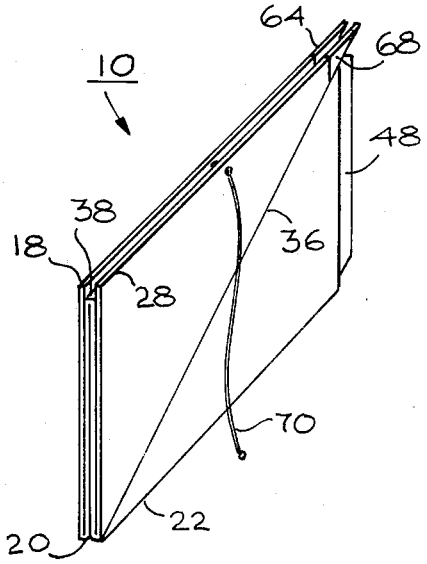
FIG. 3 illustrates the preferred embodiment of the invention in portable mode of use.
Figure 4:
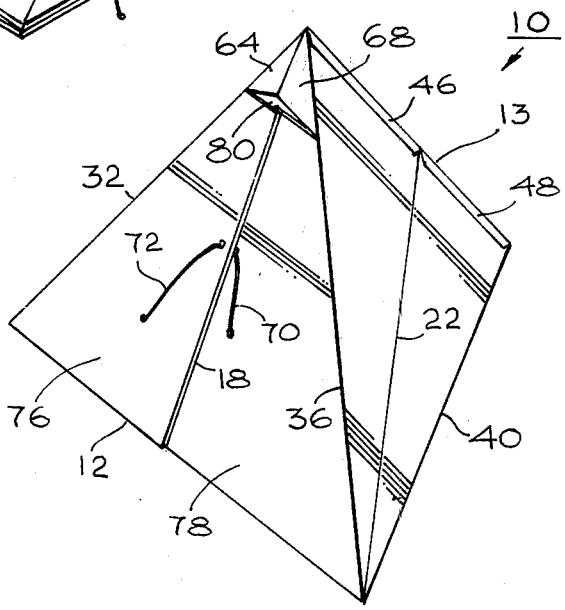
FIG. 4 illustrates the erected tetrahedral structure of the preferred embodiment of the invention.

Reference is now had to FIGS. 2, 3 and 4 wherein the folding of the elements of FIG. 1 can be seen. The blank 10 is folded along the folds 20, 22 so that the edges 14 and 16 are positioned close to each other. It will be understood that the thickness of the blank 10 illustrated in FIGS. 2 and 3 is grossly exaggerated as a matter of convenience in making the drawing clear.

Specifically, in arranging the blank 10 in its usable form, the right approximately one-quarter section of blank 10 is folded along fold 22. Similarly, the left approximately one-quarter section of blank 10 is folded in the same direction relative to the plane of FIG. 1 along fold 20. The edges 16 and 26 are joined together making the configuration as seen in FIG. 2 of the drawings. The distance between the edge 14 and fold 20 is slightly longer than the distance between the fold 20 and bifurcation 38. Likewise, the distance between edge 24 and fold 22 is slightly longer than the distance between fold 22 and bifurcation 38. Because of this slight elongation of the end section distances, the configuration of FIG. 2 is achieved. When the blank is folded along the folds 20 and 22, the edges 16 and 26 are joined together. The outside approximately one-quarter sections of the blank 10 do not come to rest flush against the center section of the blank 10. This slack is useful when the entire blank is folded along the bifurcation 38 as indicated by the arrows in FIG. 2. The extra length of the outside approximately quarter sections of the blank then allow the inside portion of the blank 10 to be folded along bifurcation 38 and fit neatly within the now connected sections 64 and 68. The compact, almost flat configuration of FIG. 3 results from this fold along the bifurcation 38.

As seen in FIGS. 2 and 3, cord 70 is provided stringing from a point adjacent the edge 28. Similarly, cord 72 is provided stringing from a point closely adjacent the edge 18. In the fold as indicated in FIG. 3, the cords 70 and 72 may be used to wrap around the flat, folded structure in order to keep it tightly packaged and easily portable.

In operation, the shelter can be erected quickly and speedily merely by unfolding the blank 10 from the fold as seen in FIG. 3, to the relatively flat position as seen in FIG. 2. By laying the blank 10 thus folded upon the ground with the blank sections 64 and 68 on the upper side, the tetrahedral shelter can be erected by raising the sections 64 and 68 above the ground while holding the center portion of the blank on the ground. It may be appreciated that when raising upwardly the sections 64 and 68 joined together, the folds 22 and 20 are straightened. Meanwhile, the various portions of the blank 10 are folded about the bifurcations 32, 42, 40 and 36. The sections immediately adjacent the fold 22 become coplanar and form a first wall of the tetrahedron. Similarly, the sections immediately adjacent the fold 20 become substantially coplanar and form a second wall of the tetrahedron. The sections of the blank 10 adjacent the bifurcation 38 remain substantially coplanar on the ground, and form the bottom floor or third wall of the tetrahedron. The fourth wall of the tetrahedron is formed by the longitudinally extreme sections of the blank 10 having the edges 14 and 24.

Because the sections 64 and 68 have dimensions somewhat abnormal to a perfect tetrahedron, and because the edges 16 and 26 are joined together, the sections 64 and 68 form two sides of an auxiliary tetrahedron protruding from the fourth wall of the erected shelter tetrahedron. The doors 76, 78 can be made substantially coplanar, so that edge 18 overlaps edge 28. The overlapping edges can provide additional insulation along this joinder. With the doors 76 and 78 substantially in the plane of the tetrahedron fourth wall, it can be seen that a hole or crack 80 in the fourth wall along the cuts 30 and 34, is provided so that air can freely ventilate within the tetrahedral shelter while providing an awning to keep rain, etc., from entering the ventilated area.

In order to keep the blank 10 in the shape of the tetrahedron as seen in FIG. 4 of the drawings, it can be seen that the two halves of the longitudinal edge 13 formed by the bifurcation 38, are joined together to make one of the six corners of the tetrahedron. It is necessary that these two halves of the longitudinal edge 13 be secured together at least as long as it is desired to keep the blank in the tetrahedral form. Thus, flap 46 is folded around the corner formed by the halves of the edge 13. Similarly, flap 48 is folded around the corner made by the edge 13. Flaps 46 and 48 may be secured to the first tetrahedron wall by any of several well-known fastening arrangements, such as by the use of the Velcro fastening principle. Zippers, glue, tape or other suitable means of fastening the flaps to the first tetrahedron wall may also be used. Flaps 50 and 52 may be secured on the inside of the tetrahedron, or may be effectively removed from the blank 10 if desired. The remaining flaps 46 and 48 form additional sealing or protection and rigidity of cardboard, preventing the elements from seeping into the tetrahedron interior through the corner seam formed by the joint edge 13. It is significant that the scoring of the cardboard to make the flaps fold easily is made along the edge 13 on only one side of the blank 10, and on that same side as are all other scorings except the scoring for bifurcation 38. Thus, all folds made in blank 10 are in the same direction relative to the plane of blank 10, except for the fold about bifurcation 38 which is for the purpose of making final folds to reduce dimensions for transporting.

The cords 70, 72 may be knotted at their ends, and made passable through their corresponding doors as far as the knot will allow. These cords 70 and 72 formerly used to secure the folded blank into a neat, substantially flat portable configuration, may now be used to tie together or otherwise to secure the doors 76 and 78. The doors 76 and 78 may be secured either from the inside or from the outside merely by pulling the cords 70 and 72 through their corresponding doors as desired.

Figure 5:
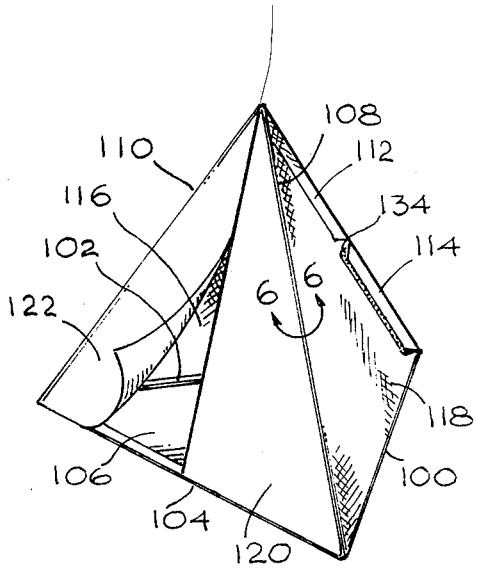
FIG. 5 illustrates an alternative embodiment of the erectable structure of FIG. 1.
Figure 6:
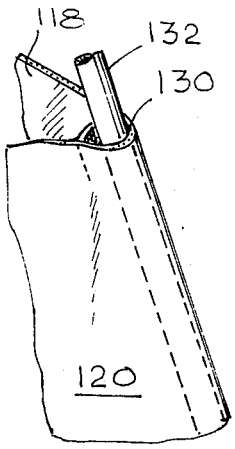
FIG. 6 represents a sectional view taken along line 6—6 of FIG. 5.
Figure 7:
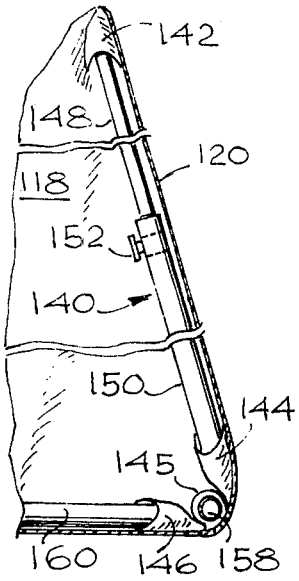
FIG. 7 represents an alternative interior structure of the alternative embodiment seen in FIG. 5.

In an alternative embodiment, a flexible blank can be cut having the same pattern or shape as shown in FIG. 1 of the drawings. The flexible material can then be folded along creases corresponding to bifurcations 32, 42, 40 and 36 to form a tetrahedral shelter, as is seen in FIGS. 5, 6 and 7 of the accompanying drawings. In the alternative embodiment shown, there is no auxiliary tetrahedron forming a space 80 for ventilating the interior, as is seen in the preferred embodiment of the invention.

The flexible material could be a fabric, such as denim or canvas, or may be a flexible plastic such as polyethylene. The flexible material is folded around a plurality of stiffening rods to form the tetrahedral shelter seen in FIG. 5. Means are provided within the flexible material to secure the stiffening rods in the tetrahedral configuration. Specifically, a stiffening rod is provided for the corners 100 and 102. For the front edge 104 of the floor 106 a bifurcated or removable stiffening rod may be provided. Also, stiffening rods are held by means provided in the corners 108 and 110.

Flaps 112 and 114 secure the back section 116 of the blank to a second back section 118 having a stiffening rod in the edge 134. It is only necessary to have the six stiffening rods to maintain the tetrahedral in a tentlike, usable shape. The vertical edges of the flexible blank adjacent the door sections 120 and 122 can be joined with a zipper, Velcro or similar type joinder which can be opened or closed as selected. When collapsing the shelter, the stiffening rod along the front may be removed. The fabric, may then be folded or rolled around the other rods which will be parallel when the shelter is collapsed.

One means for securing the stiffening rods within the flexible material may be the provision of a sleeve 130, as seen in the sectional view of FIG. 6 taken along the line 6—6 of FIG. 5. The stiffening rod 132 is placed within the sleeve 130. Stiffening rod 132, in association with the similar use of a stiffening rod along the floor corner 100 and the fastening of flaps 112 and 114 stretches the flexible section 118 into a side of the tetrahedron. Flaps 112, 114 of the blank section 116 are stretched around the outside of section 118.

An alternative stiffening rod arrangement can be provided using telescoping stiffening rods 140, as seen better in FIG. 7 of the drawings. Pockets 142, 144, 146 are provided at the ends of the stiffened corners of the tetrahedron. The stiffening rod 140 comprises a rod 148 adapted to be longitudinally telescoped within a sleeve rod 150. A mechanism such as spring 152 can be placed within the sleeve rod 150 so that the stiffening rod 140 will remain in the extended position as desired. The rod 140 then has one end placed within pocket 144 and its other end placed within pocket 142. Similar stiffening rods 158, 160 are placed within corner edge pockets and along corners to form the tetrahedral. Floor stiffening rod 160 has one end placed within pocket 146. Floor stiffening rod 158 has one end placed within pocket 145.

Figure 8:
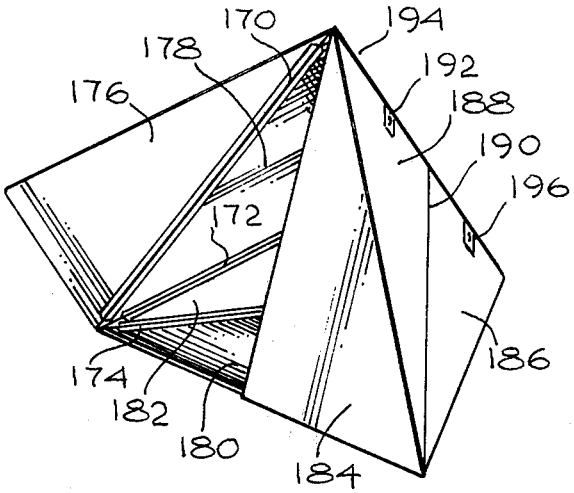
FIG. 8 represents a second alternative embodiment of the preferred embodiment of the invention as seen in FIG. 1.

In yet another alternative embodiment, the blank may be formed of a more rigid material such as plywood, and have panels cut from the blank in the general diagram or pattern as seen in FIG. 1 of the drawings. A rigid tetrahedral structure is seen in FIG. 8 of the drawings, where piano hinges 170, 172 and 174 secure various panels of the plywood material together. In particular, door panel 176 is secured to tetrahedral side panel 178 by piano hinge 170. Piano hinge 174 connects the floor panel 180 with the side panel 182. In the erected mode, the shelter panels 178 and 182 lie within a plane to form one side of the tetrahedral shelter. In the portable, traveling mode the hinge 172 allows the panels 178 and 182 to be folded against each other as described above for the preferred embodiment of the invention. Similar piano hinges, not seen, connect the door panel 184 with side panels 186 and 188. Panels 188 and 186 are secured together along fold 190 by virtue of a piano hinge, not seen, on the interior of the tetrahedral structure. As in the case of cardboard or inflexible material as described above, all folds are made in one direction relative to the plane of the blank as seen in FIG. 1.

Latching hinge 192 is provided to secure panel 178 to panel 188 along the corner 194 made by joining the longitudinal upper edges of the blank from which the plywood panels were originally cut. Similarly, hinge 196 is used to secure panel 182 to panel 186 along the same corner 194.

In converting the erected tetrahedral structure seen in perspective view in FIG. 8 into a flat, portable and folded mode similar to the folded mode of the cardboard structure as shown in FIG. 3, the latching hinges 192, 196 are unlatched. The panels 178 and 182 are allowed to fold along piano hinge 172 into abutting adjacent relationship. Similarly, panels 186 and 188 are allowed to fold along cut 190 into adjacent relationship. Panels 188 and 184 are flattened into a common plane by virtue of a piano hinge along the corner between the two panels. Similarly, door panel 176 and panel 178 are flattened along hinge 170 into a common plane. Floor 180 is flattened into a common plane with panel 182 by virtue of a swing-around hinge 174. Similarly, panel 186 is flattened into a common plane with panel 180. The now-flattened structure may be folded about a bifurcation halving the flattened structure along a cut corresponding to bifurcation 38 of the pattern shown in FIG. 1 of the drawings.

Figure 10:
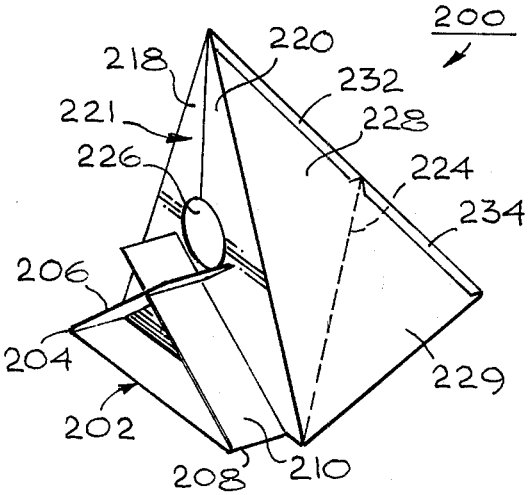
FIG. 10 shows the embodiment seen in FIG. 9 in an erected mode.
Figure 9:
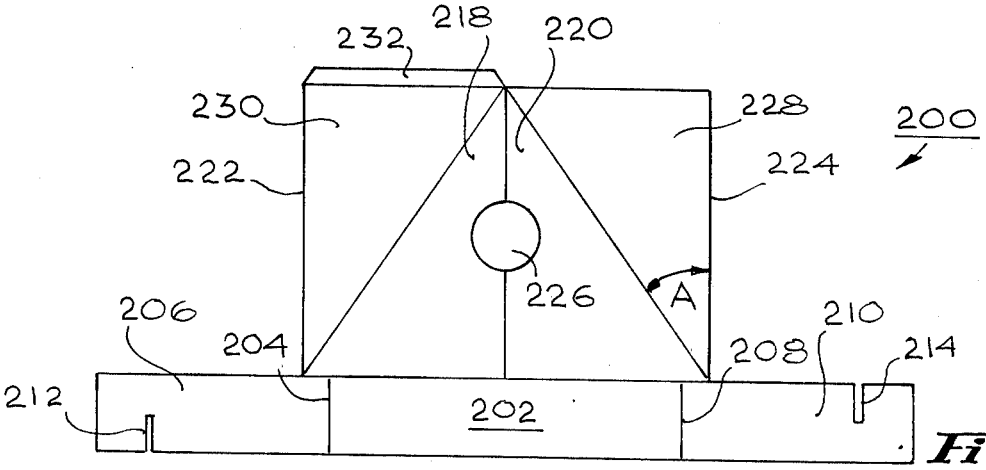
FIG. 9 represents another alternative embodiment of the preferred embodiment of the invention in folded form.

In yet another alternative embodiment of the invention, a blank similar to that of FIG. 1 is provided with an extended portion adjacent to the edge 12 of FIG. 1. As seen in FIGS. 9 and 10, blank 200 is provided with portion 202 extending forwardly from the bottom or floor of the tetrahedron. Portion 202 is scored at bifurcations 204 and 208 to form corresponding end sections 206 and 210. A short slit 212 is cut from the outside edge of the end section or portion 206. Similarly, a short slit or cut 214 is made from the inside edge of end section or portion 210. Face sections 218 and 220 have a semi-circular cut made from their free edges so that when these edges are joined together by folding along bifurcations 222 and 224, an opening 226 is provided. In FIG. 9, the face section 220 and panel 228 are shown folded about bifurcation 224, and face 218 and panel 230 are shown folded about bifurcation 222. Flaps 232 and 234 extend from the panels adjacent bifurcation 222. Panel 228 has an edge 236.

By making angle A approximately 35.2°, the front face comprised of face sections 218 and 220 will be vertical relative to the tetrahedron floor when the face is extended so as to flatten the panels adjacent bifurcations 222 and 224 into the same planes. Flaps 232 and 234 can be fastened to adjacent corresponding panels 228 and 229 to secure the tetrahedron 200 in the upright position of FIG. 10. End section 210 is folded about scoring 208. Similarly, end section 206 is folded about scoring 204, and the open cut 212 is made to receive the open cut 214 to form the crossed member form seen in FIG. 10. As in the embodiment employing flexible material seen in FIG. 5, and in the embodiment employing rigid material as seen in FIG. 8, there is no auxiliary tetrahedron formed by the special cuts on the face sections 218, 220. Rather, the face formed by the sections 218, 220 is a unitary, coplanar face of the tetrahedron with the adjacent edges of these sections abutting and secured together.

By varying the angle A or by varying the distance of the corner opposite the front face from the front face, the front face can be made at an obtuse angle to the floor sections of the tetrahedron, or alternatively can be made at a more acute angle as may be desired. This principle may be more readily appreciated by considering the schematic aspects taken along the vertical plane of the face of the tetrahedron 200, seen in FIGS. 11A, 11B and 11C of the drawings. The face 221 forms a right angle to the bottom of the tetrahedron (FIG. 11A). Angle A for such a configuration is approximately 35.2°. The length, marked in the schematic L, constitutes the height at the apex of face 221, the greatest length of the floor, and corresponds to the distance along bifurcations 222, 224. The width, marked W in the schematic, corresponds to the width along the tetrahedron base of the face 221, or twice the distance of edge 236. If angle A is 35.2°, L will be approximately 1.4 times half the distance W, or the tetrahedron will have an aspect ratio (L:W/2) of 1.4.

Figure 11C:
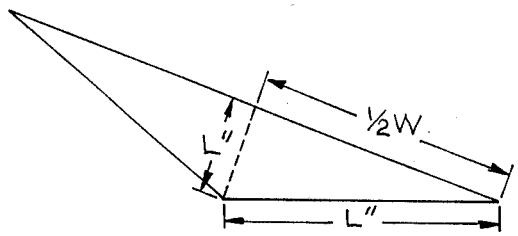
FIGS. 11A, 11B and 11C are schematic diagrams illustrating a manner in which the shape of the tetrahedron may be varied.
Figure 11A:
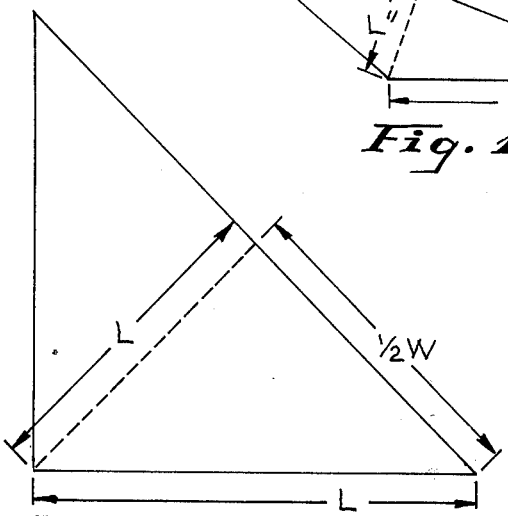
Figure 11B:
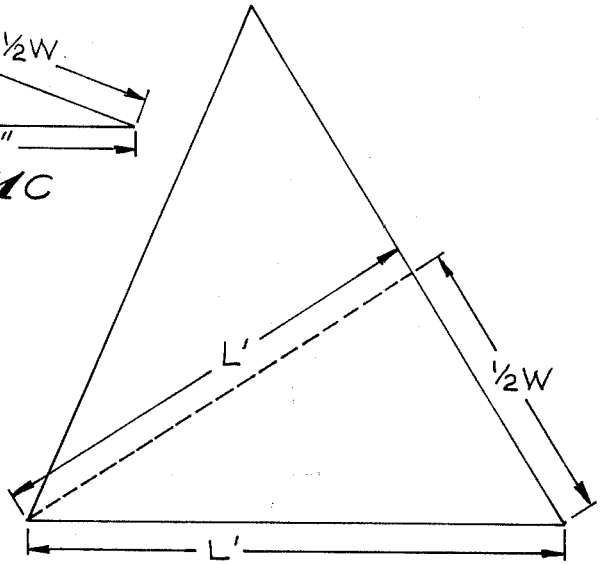

If it is desired to have a side aspect as seen in FIG. 11B having face 221' form a more acute angle with the floor of the tetrahedron, the length L' can be extended while maintaining the width W constant, that is the angle A can be decreased. Conversely, the width W can be reduced while holding the length L constant. In either event, the aspect ratio is increased.

If it is desired to have the face 221" form a more obtuse angle with the base of the tetrahedron, as schematically shown in FIG. 11C of the drawings, the length L" can be made shorter while maintaining the width W constant. Conversely, the width can be extended while maintaining the length constant. In either event, angle A is increased and the aspect ratio is reduced. An aspect as seen schematically in FIG. 11C of the drawings is then provided. Thus it may be appreciated that by varying the aspect ratio of the rectangles into which the blank 200 is divided by scoring, the shape of the shelter can be modified.

The basic tetrahedral design can be used in a wide variety or ways especially when employed with small modifications such as additions to the basic blank pattern design. For example, in the configuration shown in FIG. 10, the tetrahedral would serve remarkably as a birdhouse or bird feeder. The folded, joined portions or sections 206, 210 will provide a perch for birds which may be led through opening 226 to seed and other bird food within the tetrahedral design. Other uses and adaptations can be readily perceived once the fundamental principles of the construction of the tetrahedral design are understood.

Figure 12:
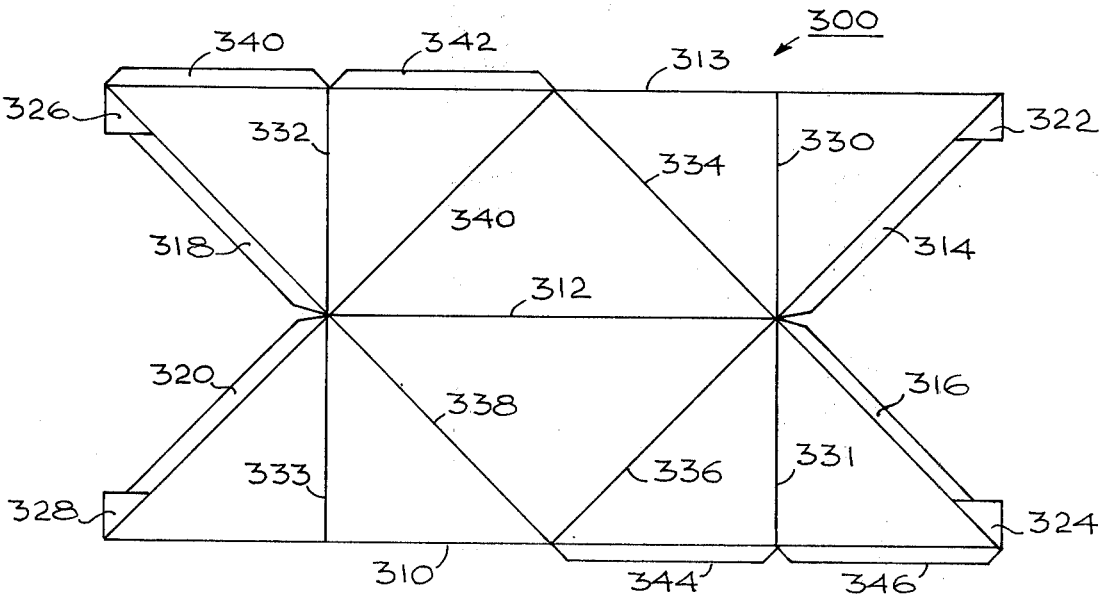
FIG. 12 illustrates another alternative embodiment of the invention as seen in FIG. 1.
Figure 13:
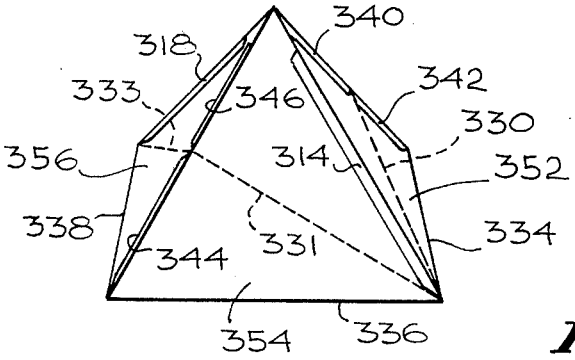
FIG. 13 shows the blank of FIG. 12 in erected form.

Yet another alternative of the basic design, seen particularly in FIGS. 12 and 13 of the drawings, will provide an increase in the amount of floor area of the tetrahedral shelter, requiring only approximately 50% increase in the amount of blank material. In FIG. 12, blank 300 is seen comprising a single blank. In the preferred embodiment, material such as cardboard or rigid plastic or the like will be used as the blank material. With certain modifications as indicated for alternative embodiments given hereinbefore, it can be appreciated that flexible material such as fabric or flexible plastic, or more rigid material such as plywood and the like can be used.

In the blank 300, longitudinal edges 310, 312 and 313 are provided parallel to each other. Longitudinal edge 313 and 312 correspond to longitudinal edges 12 and 13 in blank 10 of FIG. 1. Indeed, the blank 300 above the edge 312 corresponds to the blank 10, having the door sections 76, 78 removed therefrom. Small flaps 314, 316, 318 and 320 are provided along the vertical extremities, for purposes that will be explained in greater detail below. Additionally, small triangular extensions at the vertical extremities adjacent the longitudinal edges 310, 313 are provided in the form of small triangular butts 322, 324, 326 and 328.

The blank 300 is folded along fold lines 330, 331 the entire vertical distance of the blank. Folds 330, 331 are positioned approximately one-quarter the longitudinal distance from the extreme edge of the butts 322 and 324. Similarly folds 332, 333 extend the entire vertical distance of the blank 300 approximately one-quarter of the longitudinal distance inward from the edge of butts 326, 328.

A diagonal bifurcation 334 is provided from one end of longitudinal edge 312 at fold 330 to longitudinal edge 313 midway between the butts 322 and 326. Similarly, bifurcation 336 is provided between an end of edge 312 and the midpoint of edge 310, and forms a right angle at its intersection with bifurcation 334. Bifurcation 338 is provided between the opposite end of edge 312 and the midpoint of edge 310. Bifurcation 340 is provided between one end of edge 312 and the midpoint of edge 313, and similarly forms a right angle at its intersection with bifurcation 338. Bifurcations 340 and 336 are parallel to each other. Similarly, bifurcations 334 and 338 are parallel to each other. The blank is foldable about the edge 312. As may be noted by a comparison of blank 300 with blank 10, bifurcation 334 is similar in location to bifurcation 40, bifurcation 340 is similar in location to bifurcation 42, fold 330 is similar in location to fold 22 and fold 332 is similar in location to fold 20. Flaps 342 and 340 are provided adjacent longitudinal edge 313. Flaps 344 and 346 are provided adjacent longitudinal edge 310 as shown.

In assembling the blank 300 into a portable, relatively flat configuration, the blank 300 is folded in the same direction about folds 330, 331 and folds 332, 333. The then-abutting edges of butts 322 and 326 are joined together. The co-terminous abutting edges of butts 324 and 328 are also joined together. The blank 300 is then folded about longitudinal edge 312 and bundled together for movement from place to place.

When it is desired to erect the blank 300 into a usable shelter or lodge, the fold about 312 is flattened so that the faces adjacent to the edge 312 are made to lie in a common plane preferably on the ground. The fold 332 is flattened so that the sections adjacent the fold 332 constitute a face of a tetrahedron in a common plane. Similarly, the fold 330 is flattened so that sections of the blank adjacent the fold 330 are caused to lie in a common plane as a second face of a tetrahedron. The fold 331 is similarly flattened to cause the sections adjacent fold 331 to rest in a common plane. Likewise, fold 333 is flattened to cause portions of the blank adjacent it to lie in a common plane forming a fourth face of the multiple tetrahedral structure.

The flaps 340, 342 are folded over one-half the edge 313 onto the second face 352 to secure this corner of the multipletetrahedral structure. The flaps 340, 342 may be fastened to the second face 352 by Velcro type fasteners or any other type fastening arrangement which may prove expedient and useful. Similarly, flaps 344 and 346 are folded over the adjoining half of edge 310 and secured to the fourth face 356 in like manner. Flap 314 is conveniently folded over third face 354 and likewise secured thereto. Flap 316 may be folded in upon itself or folded to the interior surface of second face 352. Likewise, fold 318 is folded onto fourth face 356 and secured thereto. Flap 320 may be secured to the interior surface of the first face, not seen in the view of FIG. 13.

The now-adjoining surfaces of butts 322, 326 and 324, 328 may be secured to each other in order to hold the two tetrahedral halves of the multiple-tetrahedral structure together. It may be appreciated that there will be no interior wall dividing the two tetrahedral structures, and a relatively large interior can be utilized for shelter or storage. When it is desired to remove from the place where the structure has been erected, the multipletetrahedral structure may be flattened by unsecuring the flaps 340, 342, 344, 346, 314, 318 and refolding the structure into the relatively flat, compact portable structure indicated above.

Although there have been described above specific arrangements of a collapsible tetrahedral structure in accordance with the invention for the purpose of illustrating the manner in which the invention may be used to advantage, it will be appreciated that the invention is not limited to these specific arrangements. Accordingly, any and all modifications, variations or equivalent arrangements which may occur to those skilled in the art, should be considered to be within the scope of the invention as defined in the appended claims.

What is claimed is:

1. A collapsible, rigid lodgment structure comprising:

a generally rectangular rigid blank folded along a first fold and a second fold, each fold parallel to and spaced approximately one-quarter the longitudinal distance from the rectangle shorter edges, the shorter edges being joined together;

a first bifurcation running diagonally along one substantially quarter blank section defined by the first fold, and a second bifurcation running diagonally along the second quarter blank section defined by the second fold;

a third bifurcation in a center section defined by the first and second folds, the third bifurcation being parallel to the first bifurcation;

a fourth bifurcation in the center section being parallel to the second bifurcation; whereby, when the first and second folds are flattened so that the blank sections adjacent the folds are placed in a common plane, a tetrahedron is defined; and means for joining one-half of one of the blank's longitudinal edge with another half of the same longitudinal edge in a substantially weather proof line; whereby upon said joining a tetrahedron is formed.

2. The structure of claim 1 wherein the means includes at least one flap folded over the blank.

3. The structure of claim 2 wherein the means further includes a rigid pole insertable within the blank's longitudinal edge having its two sides joined together.

4. The structure of claim 2 wherein the means further includes a rigid pole inserted within at least one-half of the blank's longitudinal edge having its two halves joined together, the pole being bifurcated at least at the first fold and being capable or rigid joinder at the pole bifurcation.

5. The structure of claim 1 wherein the shorter edges are joined edge to edge only for a portion of each shorter edge length.

6. The structure of claim 5 wherein each substantially one-quarter section has a longitudinal distance longer than one-quarter the longitudinal length, whereby those portions of the shorter edges not joined overlap each other, and the edge to edge joinder projects beyond its respective plane of the tetrahedron affording ventilation to an interior of the lodgment structure.

7. The structure of claim 1 wherein all said folds and said bifurcations fold in the same direction relative to a plane of the rectangular blank.

8. The structure of claim 1 further including a fifth bifurcation equally bifurcating the longitudinal distance of the rectangular blank.

9. The structure of claim 7 wherein the fifth bifurcation folds inwardly relative to the tetrahedron, and the blank when collapsed can be folded into a relatively rectangular flat fold having a surface area approximately one-fourth the area of the surface of the rectangular blank.

10. The structure of claim 1 wherein the blank is comprised of corrugated cardboard.

11. The structure of claim 10 wherein the folds and the bifurcations comprise scores in the cardboard.

12. The structure of claim 10 wherein the folds and the bifurcations comprise scores in the cardboard.

13. The structure of claim 1 wherein the rectangular blank is comprised of substantially rigid plastic having bendable creases along each of the said folds and bifurcations.

14. The structure of claim 1 wherein the rectangular blank is comprised of precut plywood, and each fold and bifurcation comprises a cut having adjacent portions of the blank hinged to swing along the cut relative to each other.

15. A collapsible lodge structure comprising:

a foldable blank having a diamond shaped portion and first, second, third and fourth isosceles triangular shaped portions;

said first triangular shaped portion joined along one of its equal sides with a first side of said diamond shaped portion, and foldable along said side joining with said diamond shaped portion, and further foldable along an altitude of the first triangular-shaped portion;

said second triangular shaped portion joined along one of its equal sides with a second side of said diamond shaped portion, and foldable along said side joining with said diamond shaped portion, and further foldable along an altitude of the second triangular shaped portion;

said third triangular-shaped portion joined along one of its equal sides with a third side of said diamond shaped portion, and foldable along said side joining with said diamond shaped portion, and further foldable along an altitude of the third triangular shaped portion;

said fourth triangular shaped portion joined along one of its equal sides with a fourth side of said diamond shaped portion, and foldable along said side joining with said diamond shaped portion, and further foldable along an altitude of the fourth triangular shaped portion;

said first and said second triangular shaped portions being folded along their altitudes and joined together at a point opposite corresponding joinders with the diamond shaped portion, and said third and said fourth triangular shaped portions being folded about their corresponding altitudes and joined together at a point opposite the joinders of said third and said fourth triangular portions with said diamond shaped portion, whereby when the folds along the altitudes of the triangular shaped portions are flattened and the folds along the edges of the diamond shaped portion are folded, a tetrahedral structure is defined;

means for joining the base of the first triangular-shaped portion with the base of the second triangular shaped portion, and for joining the base of the third triangular shaped portion with the base of the fourth triangular shaped portion.

16. The lodge structure of claim 15 wherein the said means comprises flaps foldable from the blank.

17. The lodge structure of claim 15 further comprising means for joining a second equal side of said first triangular portion with a second equal side of said third triangular portion, and for joining a second equal side of said second triangular portion with a second equal side of said fourth triangular portion.

18. The lodge structure of claim 17 wherein the means for joining the second equal sides of the corresponding triangular shaped portions comprise flaps foldable from the blank.

* * * * *